US006126581A

United States Patent [19]

Hartsel

[11] Patent Number: 6,126,581

[45] Date of Patent: Oct. 3, 2000

[54] EXERCISE EQUIPMENT FOR SIT-UPS

[76] Inventor: Stephanie A. Hartsel, 2181 Hackberry Cir., Longmont, Colo. 80501

[21] Appl. No.: 09/183,085

[22] Filed: Oct. 16, 1998

Related U.S. Application Data

[63] Continuation of application No. 08/680,058, Jul. 15, 1996, abandoned.

[51] Int. Cl.[7] ..... A63B 26/00

[52] U.S. Cl. ..... 482/140; 482/93; 482/227; 482/256

[58] Field of Search ..... 482/140, 93, 142, 482/57

[56] References Cited

U.S. PATENT DOCUMENTS

| | | | |
|---|---|---|---|
| 4,863,158 | 9/1989 | Tassone | 482/140 |
| 5,169,372 | 12/1992 | Terro | 482/140 |
| 5,224,914 | 7/1993 | Friedman | 482/127 |
| 5,248,287 | 9/1993 | Nicoletti | 482/106 |
| 5,267,931 | 12/1993 | Faetini | 482/140 |
| 5,312,314 | 5/1994 | Stephan et al. | 482/106 |

*Primary Examiner*—Michael A. Brown
*Assistant Examiner*—Lori Baker
*Attorney, Agent, or Firm*—Lyon & Lyon LLP

[57] ABSTRACT

A piece of exercise equipment designed to shape and strengthen the abdominal muscles while providing comfort, proper positioning of the upper body, and the ability to increase intensity and effectiveness of the exercise over time. The device has a curved headpiece in which to accommodate the back of the head, and extensions which maintain arm position during exercise.

7 Claims, 3 Drawing Sheets

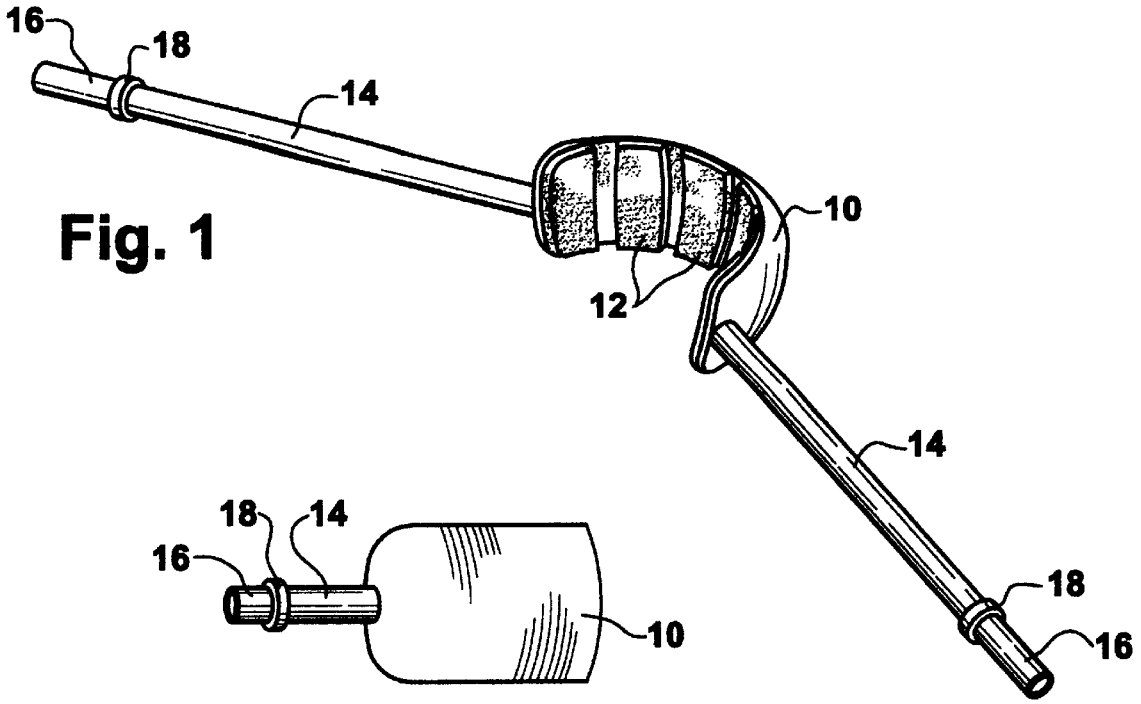
Fig. 1
Fig. 2
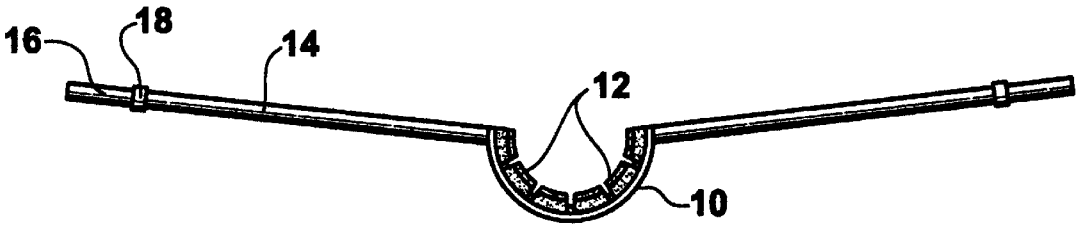
Fig. 3
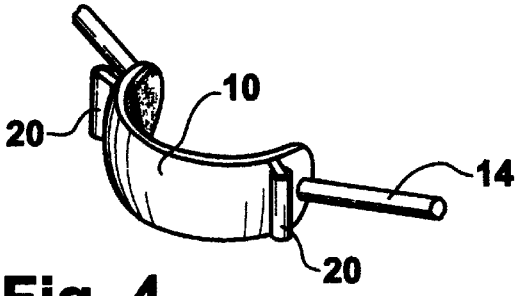
Fig. 4

EXERCISE EQUIPMENT FOR SIT-UPS

This application is a continuation of Ser. No. 08/680,058, filed Jul. 15, 1996, now abandoned.

BACKGROUND

This invention relates to the field of exercise equipment; in particular to equipment intended to enhance abdominal exercises.

SUMMARY

The exercise device of this invention is designed to shape and strengthen various muscles, including, but not limited to the rectus abdominas, external obliques, internal obliques, and transverse abdominals. The devise aids the user in maintaining proper positioning, while allowing the person to add weight resistance for increased workout intensity and strengthening.

The device has a curved headpiece, which is shaped to accept a portion of the back of a person's head, and is preferably padded on the inside. Attaches on each side of the headpiece (one on each side) are two generally rigid extensions which are designed and positioned to maintain an exerciser's arms in a beneficial exercise position, approximately in a plane through the exerciser's shoulders.

In a preferred embodiment the extensions are adjustable to allow the dimensions and/or angles of the device to be fit to the body shape and exercise needs of a particular person.

Also in preferred embodiments, the device is constructed so that additional weights can be added. Typically, but not necessarily, the ends of the extensions are adapted to hold weights by any of a variety of attachment methods (e.g., internal or external threads, clamps, collar and set screw, or insertion of weights into cavities in the extensions).

In another preferred embodiment, the device has handles attached to the headpiece. Optionally, the handles can be foldable, so that the handles can be made to lay flat against the headpiece or pulled away from the headpiece for grasping by the user during exercise.

Other features and advantages of the invention will be apparent from the following description of the preferred embodiments, and from the claims.

BRIEF DESCRIPTION OF THE FIGURES

FIG. 1 is a perspective view of an exemplary embodiment of the exercise device of the invention, showing the relationship of the headpiece and of the extensions, which are designed to position a user's arms.

FIG. 2 is a side view of the exercise device.

FIG. 3 is a longitudinal view of the exercise device, viewed along the axis of a user's body.

FIG. 4 is a perspective view of the headpiece, showing an exemplary positioning of grasping handles.

DETAILED DESCRIPTION

Figure 5:
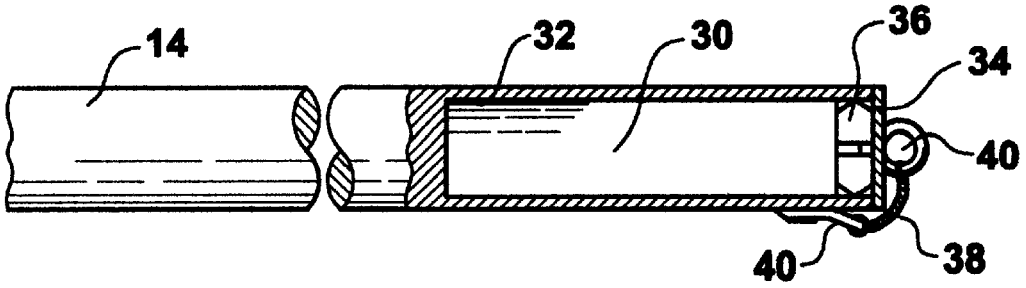
FIG. 5 is a cut-away view of the distal end of an extension which is adapted for weight addition by insertion of a weight into an internal cylindrical cavity.

As indicated above in the Summary, the present device is designed to aid in shaping and strengthening various muscles during exercise, particularly including the various abdominal muscles. The equipment assists an exerciser in maintaining proper arm and head position while performing sit-ups, and can be constructed to allow the addition of weights to provide greater resistance, thereby increasing workout intensity.

The usual position for a person performing sit-ups is reclining on his or back (flat or on an inclined board), with both hands behind the head. While it is preferable for the person's elbows to be generally in line with the shoulders, the normal tendency is for the elbows to rotate forward, generally in front of the face (i.e., elbows in front of the shoulders). When a person performs sit-ups with elbows rotated forward, he person tends to pull forward on the head, bending and spraining the neck. Also, this position encourages the exerciser to curl the abdomen, preventing the proper exercising of certain abdominal muscles and transferring an excessive portion of the strain to muscles of the lower back.

Use of this invention prevents the user's elbows from rotating forward, thereby maintaining the elbows approximately in the plane of the shoulders and head. Maintaining the elbows in this position thus enhances the abdominal exercise and reduces the undesirable strain on the neck and back.

An exemplary embodiment of the exercise device is shown in FIG. 1; the device has a curved rigid headpiece (10) which is shaped to accommodate the back portion of an exerciser's head. Typically, the headpiece receives only a portion of the back of the head, and does not extend around the face or forehead. Preferably, the headpiece also does not extend around the top of the user's head. The curvature may be simple, but is preferably compound to provide a more comfortable fit and a more stable positioning. This headpiece may be constructed of a variety of materials so long as the construction provides sufficient strength and rigidity to maintain the structural geometry of the overall device during use. Thus, for example, the headpiece may be constructed of metal (e.g., steel or aluminum), a thermoset plastic, a fiber reinforced plastic, or a combination of materials. In this embodiment, the inner portion of the headpiece is padded to provide greater comfort; the padding is provided by resilient foam strips (12) attached to the inside surface of the headpiece. A variety of other resilient materials or combinations of materials can also be used to provide such padding.

Attached on each side of the headpiece and extending generally laterally are two extensions (14). These extensions are rigidly attached to the headpiece at such an angle that, when a user's head is in the headpiece and the user's hands are placed behind the user's head, the user's arms are underneath the extensions. This prevents the elbows from simultaneously rotating forward in front of the user's face. Thus, while the torso can rotate to bring either elbow forward, the arms cannot both be rotated forward at the shoulders at the same time to bring bath elbows forward.

The typical angles between the headpiece and the extensions are shown in FIG. 3. The orientation of the device in this figure corresponds to the usual initial position during use. This shows that the extensions make a small angle upward from the horizontal (e.g., preferably in the range of 0–15 degrees). This angle allows a user's arms to be in a position which is both reasonably comfortable, but yet beneficial for exercise.

Generally, the extensions will reach to or past a user's elbows in order to comfortably restrain the arms.

As with the head piece, the extensions can be constructed of a variety of rigid or semi-rigid materials which may be the same or different as those of the headpiece. They may also have any of a variety of cross-sectional shapes, for example, solid red-shaped and round tubular. Any of a variety of methods may be used to rigidly attach the extensions to the head piece. For example, the extensions may be attached by forming the extensions in an integral unit with the head piece, by gluing, by welding, or by the use of threaded fasteners or fittings. The method of attachment will depend in part, on the materials used in constructing the head piece and extensions.

The extensions can be constructed to have various adjustments such as adjustments to the length; such length adjustments can be accomplished, for example, by providing telescoping extension members. This allows the extension length to be adjusted to fit the user's arm length. Another type of adjustment which can be provided is an angular adjustment for the angle between the side of the head piece and the extension.

The extensions and/or the head piece may also be covered on the outside with a resilient material for additional comfort and safety.

Figure 6:
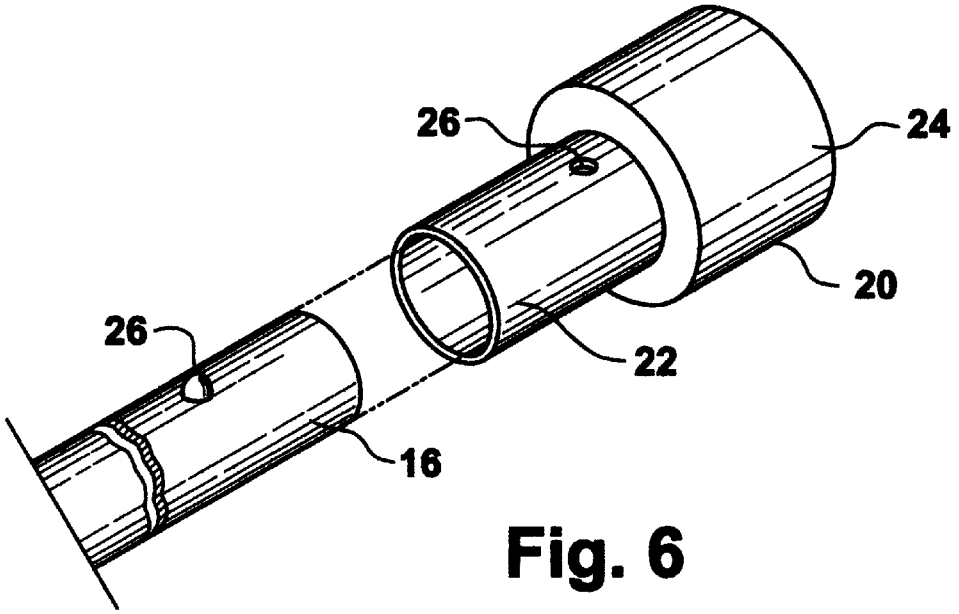
FIG. 6 is a perspective view of the distal end of an extension which is adapted for weight addition by slipping a weight piece over the end of the extension, showing a spring lock weight retaining device. The figure also illustrates an appropriate weight piece.

The extensions of the exemplary embodiment also are adapted for attaching additional weights at attachment points (16). The attachment points of this embodiment are the distal ends of each extension, which slide inside weight pieces. Stop collars (18) are provided to control the positioning of the weight pieces on the extensions. An example of a weight piece (2*a*) is shown in FIG. 6. This piece has a sleeve portion (22), which slides over the end (16) of the extension, and a weight portion (24), which provides the majority of the weight of the piece. The weight pieces are retained on the extensions by spring locks (26). A set screw mechanism could also be appropriate for retaining the weight piece.

Figure 7:
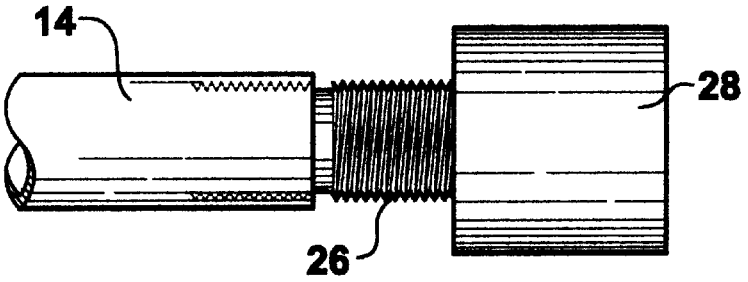
FIG. 7 is a side view of the distal end of an extension adapted for weight addition by threading a weight piece onto the threaded end of the extension, along with an exemplary weight piece.

Other methods of weight attachment may also be used in other embodiments. Another example is shown in FIG. 7. This embodiment uses a male threaded portion (27) on the end of the extension (14). The weight piece (28) has a matching female threaded portion, so that the weight piece screws onto the end of the extension. Alternatively, the extension can have a female threaded portion, and the weight piece a male threaded portion. Thus, the threaded portion of the weight piece would screw inside the end of the extension.

Another example of weight attachment is shown in FIG. 5. In this embodiment, a weight piece (30) is inserted into a cavity (32) in the end of the extension (14). In this example, the weight piece is retained in the extension cavity by means of an end plug (34). The end plug is held in place in the end of the extension cavity by means of a friction rind (36) which fits tightly against the inside wall of the cavity. The end plug is connected to the extension with a light chain (38) which is linked at each end to eyes (40) on the extension and end plug.

The device may also be fitted with handles attached to the head piece. An example is shown in FIG. 4 in which the handles (19) are fastened on the outside of the head piece below the extensions. Such handles can be either fixed or foldable; a foldable design allows the handles to be folded flat against the surface of the head piece or pulled away from the head piece for grasping during use. Handles of either type may further be removable, so that the device can be used either with or without handles at the user's preference. Also, the handles can be covered with a resilient material which can enhance comfort and provide a better grip for a user.

Figure 8:
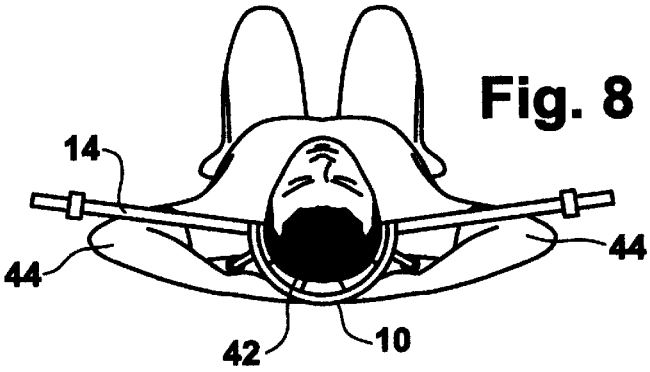
FIGS. 8–11 are perspective views illustrating the use of an appropriately positioned exercise device.
Figure 9:
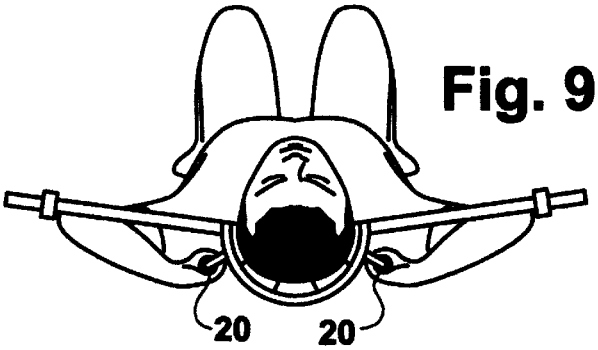
Figure 10:
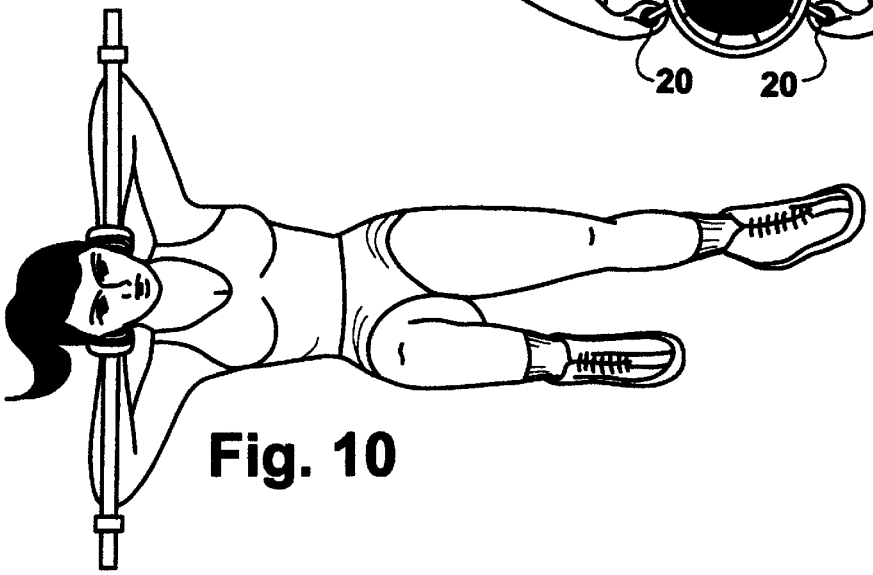

The use of the device is illustrated in FIGS. 8–11. As shown in FIG. 8, the user reclines on his or her back. The back of the head (42) rests in the headpiece (10). With the hands beneath the headpiece, the elbows (44) are behind (below) the extensions (14). FIG. 9 is similar, except that the user's hands are grasping the handles (19). For some users, the use of the handles will provide a more stable and comfortable arm postioning, and will aid in maintaining the device in the proper location. The positioning of the elbows and forearms below the extensions is also shown in FIG. 10 (as seen from above).

Figure 11:
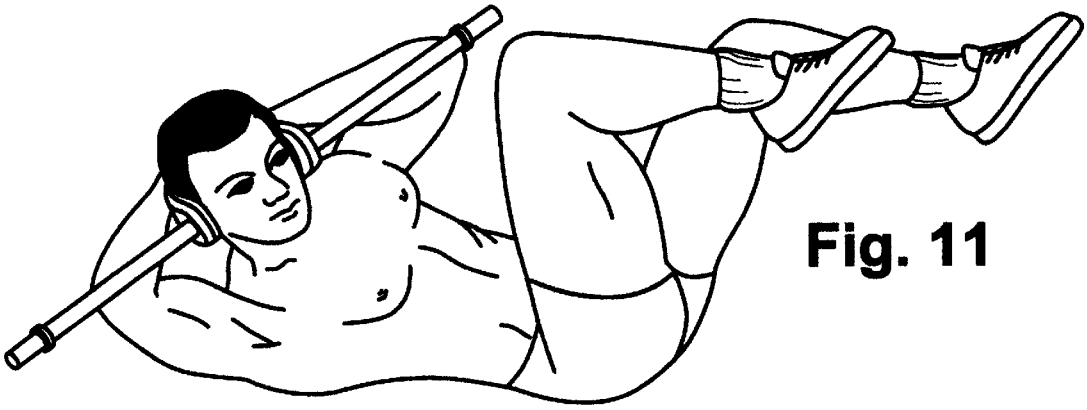

FIG. 11 illustrates a typical use of the device in an exercise ("bicycling") emphasizing the oblique abdominal muscles. In this type of exercise, the user lifts one shoulder; this places one elbow above the level of the face. However, the device restrains the other arm, improving the exercise position. This enhances the exercise of particular muscle groups.

The embodiments described herein are not intended to be limiting to the invention. Other embodiments are within the following claims.

What is claimed is:

1. A method for a person to perform an exercise, wherein said person performs the steps of:

a) reclining on a surface;

b) placing the back of his or her head within the curved headpiece of an exercise device, wherein said exercise device consists essentially of a curved headpiece shaped to accommodate the back portion of a person's head and to provide a comfortable fit and stable positioning for said person's head, and two extensions rigidly attached to opposite sides of said headpiece and extending generally laterally from said headpiece, wherein said extensions are adapted to extend generally laterally with respect to the body of a person using said device and to provide a means of positioning the elbows of a person using said device, preventing the elbows from being simultaneously lifted substantially above the level of the person's face;

c) placing his or her elbows behind said extension, and d) lifting at least one shoulder from said surface on which said person reclines.

2. The method of claim 1, wherein said persons arm are bent such that said persons hands are beneath said headpiece.

3. The method of claim 1, wherein said headpiece had a compound curvature.

4. The method of claim 1, wherein said person raises both shoulders from said surface.

5. The method of claim 1, wherein said headpiece comprises handles and said handles are grasped by said person.

6. The method of claim 1, wherein said headpiece and said extensions are constructed of different materials.

7. The method of claim 1, wherein said headpiece comprises a curved band.

* * * * *